United States Patent [19]

Shibata et al.

[11] Patent Number: 4,681,062

[45] Date of Patent: Jul. 21, 1987

[54] COATING APPARATUS

[75] Inventors: Norio Shibata; Hideo Takeda; Tsunehiko Sato; Yasunori Tanaka, all of Kanagawa, Japan

[73] Assignee: Fuji Photo Film Co., Ltd., Kanagawa, Japan

[21] Appl. No.: 733,817

[22] Filed: May 14, 1985

[30] Foreign Application Priority Data

May 14, 1984 [JP] Japan ..... 59-94657

[51] Int. Cl.[4] ..... B05L 5/02

[52] U.S. Cl. ..... 118/410; 118/407

[58] Field of Search ..... 118/410, 411, 407

[56] References Cited

U.S. PATENT DOCUMENTS 4,480,583 11/1984 Tanaka et al. ..... 118/410

4,537,801 8/1985 Takeda ..... 118/410 X

*Primary Examiner*—John P. McIntosh

*Attorney, Agent, or Firm*—Sughrue, Mion, Zinn, Macpeak & Seas

[57] ABSTRACT

A coating apparatus of the extruder type for applying a uniform coating of a solution onto a flexible support continuously run without streaking while allowing operations over extended time periods. A slot through which coating solution is supplied emerges between a doctor edge surface and a rear edge surface. The doctor edge surface is smoothly curved, and an exit end point B of the slot at the rear edge surface is located in a position that satisfies the relation $\theta_1 < \theta_2 < 180°$, where $\theta_1$ is an angle formed by a tangential line drawn to the rear edge surface at the point B and a tangential line drawn to the doctor edge surface at a point A at a downstream end of the doctor edge surface, and $\theta_2$ is an angle formed by the tangential line drawn to the rear edge surface at the point B and a tangential line drawn from the point B to the doctor edge surface.

8 Claims, 7 Drawing Figures

COATING APPARATUS

BACKGROUND OF THE INVENTION

The present invention relates to a coating apparatus. More particularly, the invention relates to an improved extruder which has a doctor edge in part of an area close to a front-most end and which continuously extrudes a coating solution so as to deposit a uniform thickness of coating material on the surface of a moving support as it is guided by the doctor edge.

The term "support" as used herein includes flexible sheets or webs such as plastic films, paper, polyolefin-coated paper, and metal sheets such as aluminum and copper. Such sheets or webs may be provided with a subbing layer. As well as being applicable to photographic film or paper, a support may be treated with a coating solution such as a magnetic paint or photographic coating solutions so as to provide a magnetic recording media.

While various coating systems are used today, the applicator of the extruder type with a doctor edge is very common and used in various fields (see, for instance, Japanese Unexamined Published Patent Application No. 138036/1975, Japanese Patent Publication No. 7306/1979, and Japanese Unexamined Published Patent Application No. 84771/1982).

The conventional extruder-type applicators have one common problem in that their operating speed ranges are very narrow. At coating speeds higher than about 100 to 150 m/min, all known previous methods have considerable difficulty in achieving consistent application of a coat having a wet thickness of 20 microns or less.

As a result of intensive studies made on this problem, the present inventors have found that the difficulty arises from the fact that if the running speed of the web is increased to about 100 to 150 m/min or higher, the amount of air that is entrapped by the extruder portion is appreciably increased. In order to provide a uniform thin coat in this range of coating speeds, it is important that the pressure of the liquid issuing from the slot be freely controllable. If only a low liquid pressure can be produced, air bubbles will enter the coat being formed, or the coating solution will flow backwardly, namely, upstream toward the extruding position. For either reason, the resulting coat is not uniform in thickness. If, on the other hand, only a high liquid pressure is possible, variations in thickness in the transverse direction can easily occur during application of the coating solution in small quantities. It has also been found that these phenomena are governed to a great extent by the shape of the edge portion, and that the known techniques and the system shown in the Japanese Unexamined Published Patent Application mentioned above can suffer both types of the problems mentioned above.

In order to eliminate these problems, the present inventors made various studies and previously proposed an applicator system of the extruder type in Japanese Unexamined Published Patent Application No. 104666/1983. A cross section of this system is shown schematically in FIG. 1, wherein the surface of a flexible support W running continuously along a back edge surface 1 and a doctor edge surface 2 is coated with a coating solution that is continuously extruded from an end of a slot 3. In this applicator system, the doctor edge surface 2 has a triangular cross section so as to enable application of the coating solution as it is slightly pressurized in a sink formed on the slot side of the doctor edge surface.

Since the coating solution in that sink is constantly pressurized during the coating process, the system prevents entrance of air at the rear edge surface and, hence, assures fast application of a uniformly thin film. However, if continuous application is carried out over long periods, streaks occur in the surface of the coat and produce a mottled appearance. This is responsible for the occurrence of adverse effects, and in the production of magnetic recording media, it impairs the S/N or C/N ratio of the final product.

The present inventors have found that such streaks are formed because of the presence of dirt or other foreign material transferred from the surface of the support (web) to the sink P and accumulated in that area as a result of extended operations. Dirt or other foreign material sticks easily to the surface of the support and cannot be completely removed by conventional cleaning techniques such as washing with water. Some such contaminant inevitably enters the coating solution being applied to the surface of the support. Since the doctor edge in the applicator shown in FIG. 1 has a triangular cross section, the dirt and other foreign material cannot be effectively ejected from the system by passing over the apex 4 of the triangle. Thus, the dirt or foreign material builds up in the sink P, causing streaks on the surface of the coating.

Therefore, the present inventors made various studies in order to develop an applicator system that retains the advantages of the system shown in FIG. 1 but which enables extended continuous operating periods without producing streaks on the surface of the coat. As a result, the inventors have found that by using a round (curved) doctor edge surface and designing a system wherein the liquid sink is held under pressure during operation, high-speed application of the coating solution can be realized without producing undesired streaks on the surface of the coat.

SUMMARY OF THE INVENTION

The principal object of the present invention is to provide an applicator system that is free from the defects of the prior art techniques and which enables high-speed application of a uniformly thin film without producing streaks on the surface of the coated film.

The present invention provides a coating apparatus of the extruder type which applies a coating solution onto the surface of a flexible support running continuously along rear edge and doctor edge surfaces by continuous extrusion of the coating solution from the frontmost end of a slot, characterized in that the doctor edge surface is smoothly curved and the exit end B of the slot at the rear edge surface in a cross section of the coating apparatus is located at a position that satisfies the relation $\theta_1 < \theta_2 < 180°$, where $\theta_1$ is an angle formed by a tangential line drawn to the rear edge surface at a point B and a tangential line drawn to the doctor edge surface at a point A at the downstream end of the doctor edge surface in a cross section of the coating apparatus, and $\theta_2$ is an angle formed by a tangential line drawn to the rear edge surface at the point B and a tangential line drawn from the point B to the doctor edge surface.

DESCRIPTION OF THE PREFERRED EMBODIMENTS

Preferred embodiments of the present invention are hereunder described in detail by reference to FIGS. 2 to 7.

Figure 1:
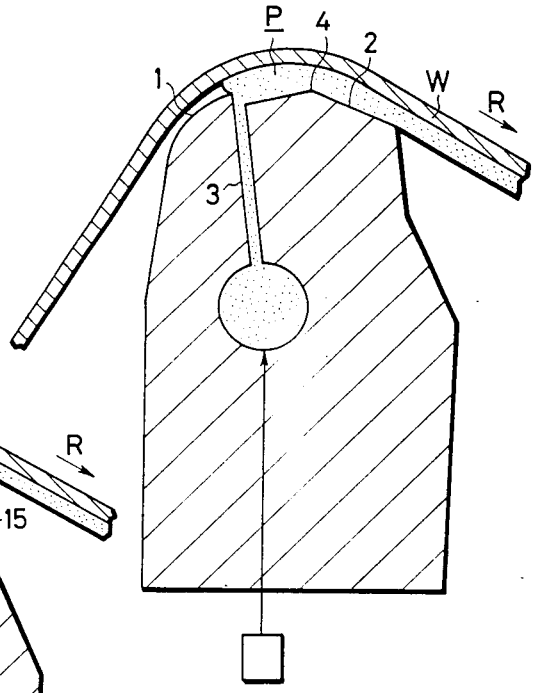
FIG. 1 PRIOR ART
FIG. 1 is a cross section of a coating apparatus proposed in Japanese Unexamined Published Patent Application No. 104666/1983.
Figure 2:
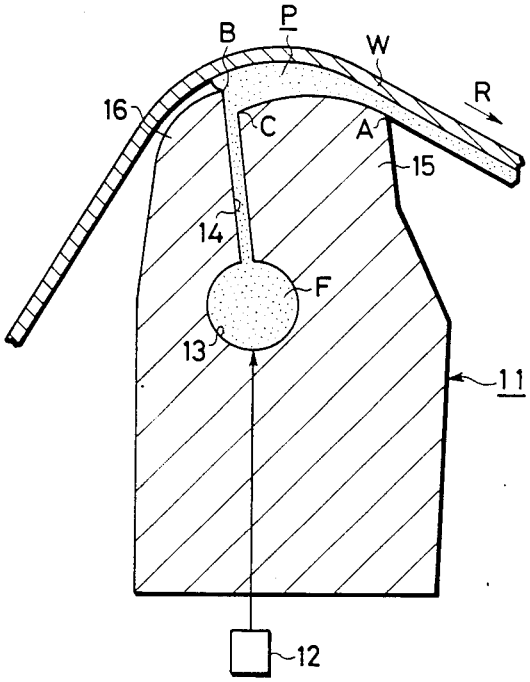
FIGS. 2 and 3 are cross sections of an extruder in a coating apparatus constructed in accordance with a preferred embodiment of the present invention.

FIG. 2 is a cross section showing schematically an application of a coating apparatus constructed in accordance with a preferred embodiment of the present invention in actual service. The extruder-type applicator of the present invention, which is equipped with a doctor edge and is generally indicated at 11 (the applicator is hereinafter simply referred to as the extruder 11), is composed essentially of a feed unit 12, a pocket portion 13, a slot portion 14, a doctor edge portion 15 and a rear edge portion 16. Details of the respective components are described below.

(1) Feed unit 12:

The feed unit 12 is composed of a pump (not shown) which is located outside the housing of the extruder 11 and which is capable of feeding continuously a given amount of the coating solution F, and piping that establishes communication between the pump and the pocket portion 13 that is formed through the housing of the extruder 11 in the direction that transverses the width of the support W.

Figure 5:
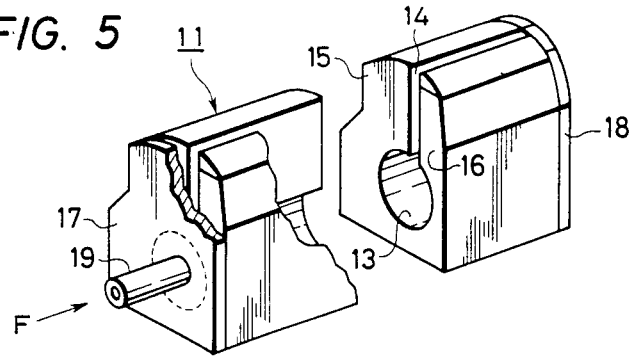
FIG. 5 is a fragmentary perspective view of the extruder in FIGS. 2 and 3.

(2) Pocket portion 13:

The pocket portion 13 is a type of liquid sink that has a generally circular cross section and extends, as shown in FIG. 5, across the width of the support W without substantial variation in its cross section. The extension of the pocket portion 13 generally has an effective length which is equal to or slightly greater than the coating width.

The two open ends of the pocket portion 13 that run through the extruder 11 are respectively closed with shields 17 and 18 that are attached to the ends of the extruder.

A short pipe 19 projecting from the shield 17 is connected to the feed unit 12, from which the coating solution F is supplied into the pocket portion 13. After the pocket 14 is filled with the coating solution F, the latter is pushed through the slot portion 14 (described below) and ejected to the outside to provide a uniform liquid pressure distribution.

(3) Slot portion 14:

The slot portion 14 is a channel with a relatively small gap (typically 0.03 to 2 mm) that extends from the pocket portion 13 toward the support W through the housing of the extruder 11 and which, like the pocket portion 13, extends across the width of the support W. The length of the opening at the slot portion 14 across the width of the support W is set to a value substantially equal to the coating width.

The length of the channel extending toward the support W is a design parameter that should be properly determined by considering the composition and properties of the coating solution F and the flow rate and pressure of the solution being supplied. The only requirement that must be met by the slot portion 14 is that it enable the coating solution F to run from the pocket portion 13, forming a laminar flow that provides a uniform flow rate and pressure distribution across the width of the support W.

The exit end of the slot portion 14 meets the doctor edge portion 15 at one side C, and the rear edge portion 16 at the other side B, which is located at a position slightly therebelow in accordance with the present invention.

(4) Doctor edge portion 15 and rear edge portion 16:

The doctor edge portion 15 is positioned downstream of the exit end of the slot portion 14 in the direction in which the support W runs, and the back edge portion 16 lies upstream in the opposite direction. In accordance with the present invention, the doctor edge portion 15 has a cross section such that the edge surface opposite the support W is round or curved.

Figure 3:
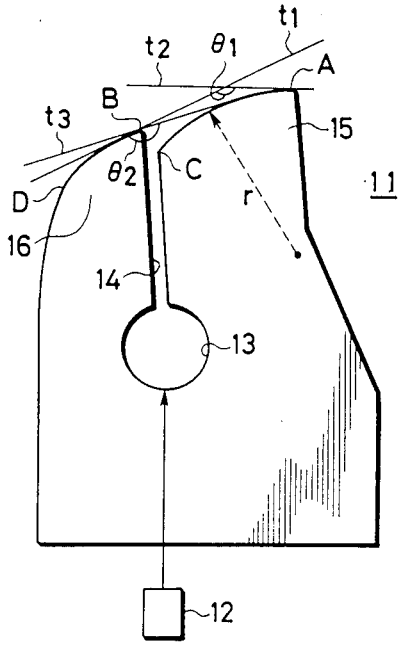
Figure 4:
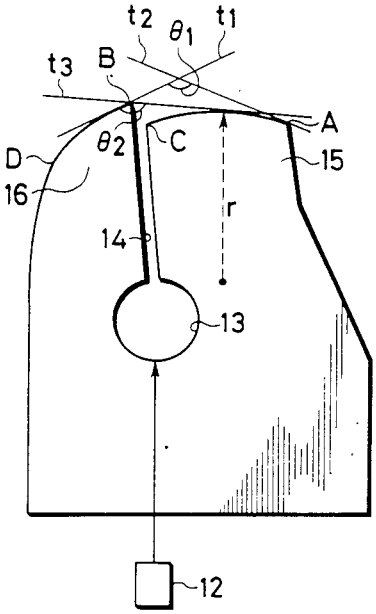
FIG. 4 is a cross section showing another embodiment of the extruder.

As better illustrated in FIGS. 3 and 4, the exit end B of the slot at the rear edge surface is located at a position that satisfies the following relation: $\theta_1<\theta_2<180°$, where $\theta_1$ is the angle formed by a tangential line $t_1$ drawn to the rear edge surface at point B and a tangential line $t_2$ drawn to the doctor edge surface at point A at the downstream end of the doctor edge surface, and $\theta_2$ is the angle formed by the tangential line $t_1$ and a tangential line $t_3$ drawn from point B to the doctor edge surface.

The doctor edge surface generally has a radius of curvature r of about 2 to 20 mm, more preferably about 3 to 10 mm. The effective length of the doctor edge surface as defined by the distance between A and C is generally in a range of about 0.6 to 17 mm (measured along the curved surface). The effective length of the rear edge surface, as defined by the distance between B and D, which contacts the support is generally in a range of about 0.1 to 50 mm. The rear edge surface may be flat or slightly rounded.

So long as the relation $\theta_1<\theta_2<180°$ is satisfied, the exit end B of the slot at the rear edge surface may be positioned below point A of the doctor edge surface shown in FIG. 3, or above point A, as in FIG. 4. In either case, a pressurized liquid sink P as shown in FIG. 2 is formed during the coating process so as to prevent the entrance of air at the rear edge surface. Additionally, because of the roundness of the doctor edge surface, any dirt or foreign material that has been carried by the support is rapidly ejected from the extruder together with excess coating solution without collecting in the sink P. As a result, a uniformly thin film can be applied at a fast rate without forming streaks as in the case of the prior art applicators.

In accordance with the present invention, a generally constant tensile force is imposed on the support W by transport guides, such as guide rollers, so that it is capable of assuming the slightly curved shape in the direction of its thickness. An extruder support mechanism (not shown) then brings the support W into the proximity of the doctor edge portion 15 and the rear edge portion 16 so that the support is curved generally parallel to these edge portions. At the same time, the coating solution F is fed at a desired rate from the feed unit 12. The coating solution F passes through the pocket portion 13 and slot portion 14 and is pushed toward the exit end of the slot portion 14 to provide a uniform flow rate and pressure distribution across the width of the support W.

With the doctor edge portion 15 and rear edge portion 16 having the shapes specified herein-above, the coating solution F that is pushed to the exit end of the slot portion 14 creates a properly controlled liquid pressure and prevents the entrance of air trapped on the support W. Furthermore, the stream of the coating solution F forms a very small gap between the surface of the support W and the two edge portions while passing under the rear surface of the continuously moving support W (the moving direction of the support is indicated by the arrow R) in such a manner that the support W and the curved surface of the doctor edge portion 15 are spread apart by the thrust of the coating solution.

When the coating solution F moves continuously in the manner described above, the entire surface of the doctor edge portion 15 and the surface of the support W are kept a certain distance apart from each other by the thin film of the coating solution F that passes between the two surfaces across the width of the support.

The distance by which the two surfaces are separated is determined by process conditions such as the tension on the support W and the supply rate of the coating solution F. A particular advantage of the present invention is that the desired distance, and hence the thickness of the final coat, can be obtained very easily and accurately by simply modifying the setting of the supply rate of the coating solution F.

The doctor edge portion 15 or the rear edge portion 16 may be made of a super-hard alloy or ceramics. By providing these edge portions with a high degree of straightness and flatness, the distance by which the entire surface of the doctor edge portion is separated from the surface of the support W is provided with a higher uniformity across the width of the support. As a consequence, even faster application of a thin film with a higher uniformity of thickness can be realized.

Figure 6:
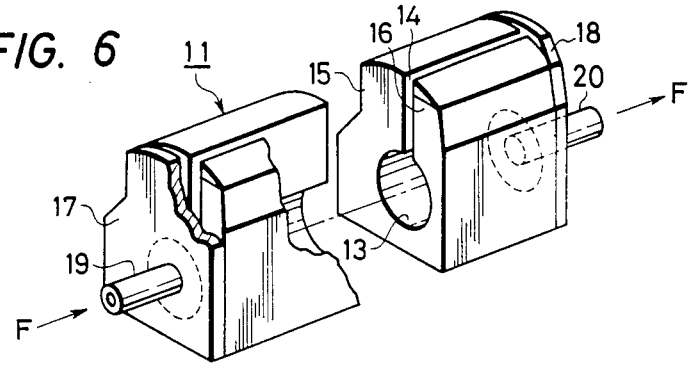
FIGS. 6 and 7 are perspective views showing two modified methods of supplying the coating solution to the extruder in the apparatus of the present invention.
Figure 7:
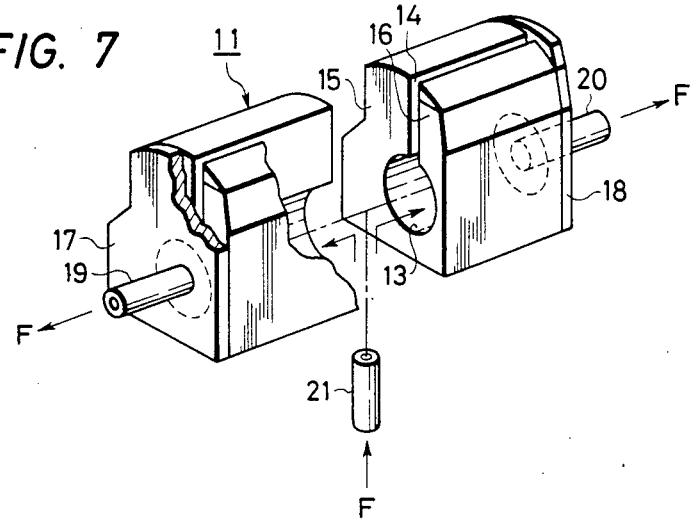

The method of supplying the coating solution F to the pocket portion 13 may be modified as illustrated in FIGS. 6 and 7. In the embodiment shown in FIG. 6, the coating solution is supplied from one side of the extruder, as in the case shown in FIG. 5. The difference is that a short pipe 20 is connected to the shield plate 18 in addition to the short pipe 19 on the shield 17. Part of the coating solution F supplied into the pocket portion 13 through the short pipe 19 is ejected to the outside through the short pipe 20. This arrangement is capable of preventing excessive stagnation of the coating solution F within the pocket portion 13 and proves particularly effective in supplying a magnetic coating solution that is thixotropic and has a great tendency toward agglomeration of magnetic particles.

The embodiment shown in FIG. 7 represents a further modification of the embodiment of FIG. 6. In this embodiment, a third short pipe 21 that communicates with approximately the central part of the pocket portion 13 is provided in addition to the short pipes 19 and 20. The coating solution F is supplied into the extruder through this pipe 21. Part of the coating solution supplied into the pocket portion 13 is ejected to the outside of the extruder through the pipes 19 and 20 on both sides, while the remainder is extruded through the slot portion 14 to provide an even more uniform pressure distribution at the exit end of the slot portion without standing in the pocket portion 13.

The method of supplying the coating solution in the apparatus of the present invention is not limited to the embodiments shown in FIGS. 5 to 7, and they may be combined in suitable manners. The pocket portion 13 in the embodiments shown above is cylindrical, but other shapes such as that having a rectangular cross section or resembling the bottom of a ship may be used so long as a uniform liquid pressure distribution is obtained across the width of the support.

The coating apparatus of the present invention described above has the following advantages:

(1) High-speed and uniform coating operations can be realized without air entrapment or the development of streaks on the surface of the coat that results from dirt or other foreign material being deposited on the support.

(2) The apparatus is adapted to the application of a thin film, and a liquid solution can be applied to form a uniform coat having a wet thickness of as small as 10 microns.

(3) The liquid pressure at the exit end of the slot portion 14 can be controlled to a desired value so that contact between the support and the edge portion and subsequent damage to either member can be avoided.

(4) Being capable of controlling the liquid pressure at the exit end of the slot portion 14 to a desired value, the apparatus of the present invention is adapted to the application of coating solutions having a wide range of viscosities. This capability is enhanced by forming the edge portions with a super-hard alloy or ceramic material. A particular advantage results from the use of super-hard alloys or ceramic materials as the materials of the edge portions since in such case they are sufficiently protected from the wearing action of the magnetic coating solution so as to minimize the deterioration of the initial performance of the coating apparatus.

The advantages of the application of the present invention will become more apparent from the following Example.

EXAMPLE

Samples of magnetic coating solution were prepared from the components shown in Table 1 below. They were thoroughly mixed in a ball mill, and, after adding 30 parts by weight of an epoxy resin (epoxy equivalent: 500), the mixture was further agitated to form a uniform dispersion.

TABLE 1

| Component | Amount (parts by weight) |
|---|---|
| $\gamma$ - $Fe_2O_3$ powder (acicular particles with an average length of 0.5 microns and a coercive force of 320 Oe) | 300 |
| Vinyl chloride-cinyl acetate copolymer (copolymerization ratio = 87:13, degree of polymerization = 400) | 30 |
| Conductive carbon | 20 |
| Polyamide resin (amine value: 300) | 15 |
| Lecithin | 6 |
| Silicone oil (dimethyl polysiloxane) | 3 |
| Xylol | 300 |
| Methyl isobutyl ketone | 300 |
| n-Butanol | 100 |

The equilibrium viscosity of the samples of magnetic solution thus prepared was measured with a rheometer (Model RM-1, product of Shimadz Seisakusho, Ltd., of Japan). The results were 8 poise at a rate of shear of 10 $sec^{-1}$, and 1 poise at 500 $sec^{-1}$.

The coating solution samples were coated on supports with applicators. The coating conditions, the extruders used, and the coating thicknesses obtained were as follows:

1. Support
Material: polyethylene terephthalate film
Thickness: 20 microns
Width: 300 mm
Tension: 2 kg/total width and 4 kg/total width
Moving speed: 100 m/min, 150 m/min, 200 m/min and 300 m/min.
2. Extruder
No. 1: In accordance with the present invention (FIGS. 2 to 4)
No. 2: In accordance with Japanese Unexamined Published Patent Application No. 84771/1982
3. Coating thickness (on a wet basis):
10 microns, 20 microns, and 50 microns.

The results of the coating operation are shown in Table 2 by the following indices of rating:

O satisfactory results were obtained in all cases;
Δ satisfactory results were obtained but with poor reproducibility;
X application of a uniform coating was impossible.

TABLE 2

| | Coating Thickness (microns) | | | | | |
|---|---|---|---|---|---|---|
| | The Present Invention | | | Japanese Unexamined Published Patent Appln. No. 84771/1982 | | |
| Coating Speed | 10 | 20 | 50 | 10 | 20 | 50 |
| 100 m/min | O | O | O | Δ | O | O |
| 150 m/min | O | O | O | Δ | Δ | X |
| 200 m/min | O | O | O | X | X | X |
| 300 m/min | O | O | O | X | X | X |

Table 2 shows that the coating apparatuses of the present invention were capable of high-speed application to produce uniformly thin coatings.

Another experiment was conducted to check how many streaks formed when the samples of magnetic coating solution were applied to supports under the following conditions.

1. Support
Material: polyethylene terephthalate film
Thickness: 20 microns
Width: 300 mm
Tension: 4 kg/total width
Moving speed: 100 m/min
Coating length: 4,000 m
2. Extruder
No. 1: In accordance with the present invention (FIGS. 2 to 4)
No. 2: In accordance with Japanese Unexamined Published Patent Application No. 104666/1983
3. Coating thickness (on a wet basis):
10 microns, 20 microns, and 50 microns. The number of streaks that developed as a result of the coating operation is shown in Table 3.

TABLE 3

| Coating Thickness (microns) | Extruder | |
|---|---|---|
| | The Present Invention | Japanese Unexamined Published Patent Application No. 104666/1983 |
| 10 | 0 | 6 |
| 20 | 0 | 3 |
| 50 | 0 | 1 |

As Table 3 shows, not a single streak developed when coating was performed with the apparatuses of the invention.

We claim:

1. A coating apparatus of the extruder type which applies a coating solution onto the surface of a flexible support running continuously along rear edge and doctor edge surfaces by continuous extrusion of the coating solution from a frontmost end of a single slot, the improvement wherein said rear edge surface is curved and said doctor edge surface is smoothly curved in an arcuate fashion having a constant radius, and an exit end at a point B of a slot at a rear edge surface in a cross section of said coating apparatus is located at a position that satisfies the relation $\theta_1 < \theta_2 < 180°$, where $\theta_1$ is an angle formed by a tangential line drawn to said rear edge surface at said point B and a tangential line drawn to said doctor edge surface at a point A at a downstream end of said doctor edge surface in a cross section of said coating apparatus, all of said apparatus being contained within an interior of said angle $\theta_1$, and $\theta_2$ is an angle formed by said tangential line drawn to said rear edge surface at said point B and a tangential line drawn from said point B to said doctor edge surface, all of said apparatus being contained within an interior of said angle $\theta_2$.

2. The coating apparatus according to claim 1, wherein said doctor edge surface has a radius of curvature in a range of 2 to 20 mm.

3. The coating apparatus according to claim 1, wherein said doctor edge surface has a radius of curvature in a range of 3 to 10 mm.

4. The coating apparatus according to claim 1, wherein an effective length of said doctor edge surface is in a range of 0.6 to 17 mm.

5. The coating apparatus according to claim 1, wherein an effective length of said rear edge surface is in a range of 0.1 to 50 mm.

6. The coating apparatus according to claim 1, wherein an end of said slot remote from said doctor edge surface is communicated with a pocket portion for supplying said coating solution through said slot, and further comprising means for supplying said coating solution to said slot from one end thereof, a second end of said pocket portion being blocked.

7. The coating apparatus according to claim 1, wherein an end of said slot remote from said doctor edge surface is communicated with a pocket portion for supplying said coating solution through said slot, and further comprising means for passing a flow of said coating solution longitudinally through said pocket portion.

8. The coating apparatus according to claim 1, wherein an end of said slot remote from said doctor edge surface is communicated with a pocket portion for supplying said coating solution through said slot, and further comprising means for supplying a flow of said coating solution to said pocket portion at a central part thereof, and means for passing portions of said coating solution from ends of said pocket portion, whereby flows in opposing directions are created in opposite ends of said pocket portion.

* * * * *